US006206264B1

(12) United States Patent
Furlani et al.

(10) Patent No.: US 6,206,264 B1
(45) **Date of Patent: *Mar. 27, 2001**

(54) APPARATUS AND METHOD FOR CONVEYING ABRASIVE WEB OF INDETERMINATE LENGTH

(75) Inventors: Edward P. Furlani, Lancaster; Syamal K. Ghosh; Dilip K. Chatterjee, both of Rochester, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/080,794

(22) Filed: May 18, 1998

(51) Int. Cl.[7] ..... B65H 20/00; B25F 5/02
(52) U.S. Cl. ..... 226/186; 226/193; 492/59
(58) Field of Search ..... 226/186, 193; 492/59

(56) References Cited

U.S. PATENT DOCUMENTS 2,918,069 * 12/1959 Brown, Jr. et al. ..... 226/186 X
3,133,340 * 5/1964 Finelli ..... 492/59
3,779,051 * 12/1973 Kuesters ..... 492/59 X
4,255,038 * 3/1981 Simon et al. .
4,719,484 * 1/1988 Tahara et al. ..... 228/181 X
4,794,680 * 1/1989 Meyerhoff et al. .
5,008,138 * 4/1991 Murata ..... 492/59 X
5,054,940 * 10/1991 Momose et al. ..... 384/907.1 X
5,072,689 * 12/1991 Nakagawa et al. ..... 384/907.1 X
5,083,873 * 1/1992 Momose et al. ..... 384/907.1 X
5,135,314 * 8/1992 Momose et al. ..... 384/907.1 X
5,364,697 * 11/1994 Miyabayashi ..... 492/59 X
5,418,590 5/1995 Earle et al. .
5,493,360 2/1996 Pummell et al. .
5,582,885 * 12/1996 Nakamura et al. ..... 492/59 X
5,803,887 * 9/1998 Fukunaga ..... 492/59
5,827,160 * 10/1998 Ohki et al. ..... 492/59 X

* cited by examiner

*Primary Examiner*—Michael R. Mansen
(74) *Attorney, Agent, or Firm*—Clyde E. Bailey, Sr.

(57) ABSTRACT

An apparatus (10) for conveying abrasive web (16) of indeterminate length, such as photographic media, has first and second closely spaced rollers (12, 14) with at least one of the rollers (12, 14) having a polymeric/inorganic composite media bearing surface (70). The abrasive web or media (16) is disposed between a nip (18) defined by the close spacing between the rollers (12, 14) and is in moving contact with the polymeric/inorganic composite media bearing surface (70) while being conveyed through the nip (18).

5 Claims, 4 Drawing Sheets

APPARATUS AND METHOD FOR CONVEYING ABRASIVE WEB OF INDETERMINATE LENGTH

FIELD OF THE INVENTION

This invention relates to an apparatus and method for conveying abrasive media. More particularly, the invention concerns a polymeric/inorganic composite roller apparatus and method having durable and abrasion resistant surfaces for conveying abrasive web, such as photographic media, of indeterminate length during processing.

BACKGROUND OF THE INVENTION

Conventional web converting equipment uses some sort of transport mechanism for moving the web at high rates of speeds through a series of processing stations. Typically such processing stations includes corrosive environments through which the web must be transported. For instance, in existing photographic film processors used to develop and fix photosensitive elements which are subjected to x-ray, visible and other radiation, the web is transported via a series of rollers defining a web transport path through a sequence of processing stations including wash and dry stations.

Very often during processing, photosensitive media are coated with a magnetic layer to enable it to gather digital information. The magnetic layer often contains a small fraction of hard inorganic particles to facilitate cleaning of the magnetic head which are used for reading digital information in a read-out device. Photographic films are also coated with an "anti-stat" layer for dissipating static charges from the moving web. The anti-stat layers generally contain hard abrasive particles like tin oxide, antimony oxide, vanadium oxide and the like.

Moreover, process and transport apparatus for photosensitive web or other media is another well known applications requiring a web transport mechanism. Such equipment may include automatic processing of the media for thermal, ink jet or silver halide-based photographic printing, and the like. The apparatus automatically transports sheets or webs or strips of photosensitive films, photosensitive papers or specially coated papers or plain papers. For photosensitive elements, this apparatus transports from a feed end of a film transport path, through a sequence of chemical processing tanks in which the media is developed, fixed, and washed, and then through a dryer to a discharge or receiving end. The processing equipment typically has a fixed film (media) path length, so final image quality depends on factors including transport speed which determines length of time the media is in solution, and the temperature and composition of the processing chemicals.

In general, many elements of devices (such as, photographic film processors and thermal and ink jet printers) exposed to harsh chemicals are made from AISI 300 series stainless steel or engineering plastic for reasons of mechanical strength, lower cost, and relatively good corrosion resistance. Engineering plastics are typically used as bushings and gears because of their relatively low coefficient of friction against stainless steel. Furthermore, photographic transport apparatus exposed in normal ambient conditions are also prone to wear and corrosion because of the abrasive and corrosive nature (depending on their relative humidity) of the photographic elements. Although stainless steel shafts have considerable strength and corrosion resistance, they are prone to wear with time and are also susceptible to corrosion when they come in contact with harsh chemicals which are used in "fixer" solution for developing photographic films.

To overcome these drawbacks, many engineering plastics are reinforced with glass and carbon fibers or other hard inorganic particles to improve the strength and wear resistance at the expense of proneness to corrosion. Another problem associated with plastic components operating in a fluid environment is that they tend to swell and become dimensionally unstable.

Therefore, a need persists for an apparatus having a polymeric/inorganic composite media bearing surface for conveying abrasive web such as, photographic media.

SUMMARY OF THE INVENTION

It is, therefore, an object of the invention to provide an apparatus for conveying abrasive web, such as photographic media, of indeterminate length that utilizes a polymeric/inorganic media bearing surface.

Another object of the invention is provide an apparatus for conveying abrasive media that includes compliant media conveyance rollers having a media bearing surface comprising hard wear and abrasion resistant particulate inorganic materials embedded therein.

Still another object of the invention is to provide an apparatus for conveying abrasive media that includes compliant media conveyance rollers having a media bearing surface comprising hard, wear and abrasion resistant and electrically conductive particulate inorganic materials embedded therein for dissipating static charges.

It is, therefore, a feature of the invention that a media bearing surface of an apparatus and method for conveying abrasive media comprises inorganic particulates in a polymeric material matrix.

Accordingly, for accomplishing these and other objects, features and advantages of the invention, there is provided, in one aspect of the invention, an apparatus for conveying abrasive media of indeterminate length comprising a mounting means, such as a frame, and first and second rollers mounted for synchronous rotation in the frame. According to the invention, any one of the first and second rollers has a media bearing surface comprising, in a mixture, a polymeric matrix and an inorganic particulate material. Moreover, first and second rollers are closely space to form a nip therebetween. As the web or media is squeezed for movement between the nip, the media bearing surface of at least one of the first and second rollers is in contact therewith. Drive means, such as a motor, operably connected to any one of the first and second rollers rotates the roller and causes the other of first and second rollers to synchronously rotate therewith. Thus, when abrasive media of indeterminate length is disposed between the nip, the media is squeezed for movement between the first and second rollers while contacting the composite media bearing surface.

In another aspect of the invention, a method of conveying abrasive media of indeterminate length includes providing the apparatus described above and then disposing the abrasive media between the nip of the first and second rollers. The media, while moving through the nip, remains in moving contact with the composite media bearing surface of at least one of the conveyance rollers, as described above.

It is, therefore, an advantage of the invention that an apparatus for conveying abrasive web, such as photographic media, is simple to produce, assemble and operate. Another advantage of the invention is that the media bearing surface is sufficiently compliant to accommodate abrasive media of varying thickness. Further, the conveyance apparatus of the invention offers the advantage of providing sufficient friction to enable the movement of abrasive media between independent processing stations in a corrosive environment.

BRIEF DESCRIPTION OF THE DRAWINGS

The above mentioned and other objects, features and advantages of the invention and the maimer of attaining them will become more apparent and the invention itself will be better understood by reference to the following description of an embodiment of the invention taken in conjunction with the accompanying drawings, like numerals indicating similar features, and wherein.

DETAILED DESCRIPTION OF THE INVENTION

Figure 1:
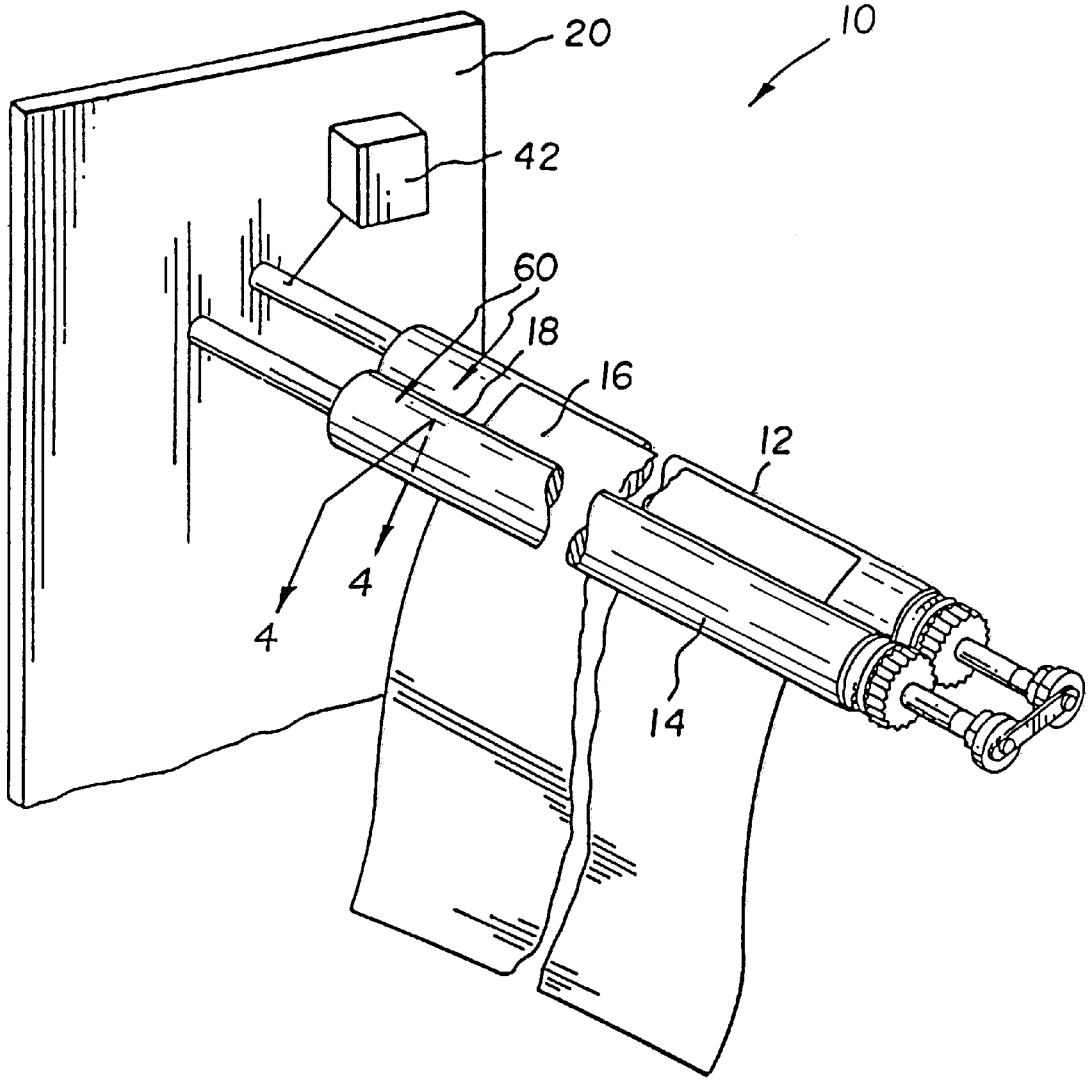
FIG. 1 is a perspective view, partially torn away, of the apparatus of the invention.
Figure 2:
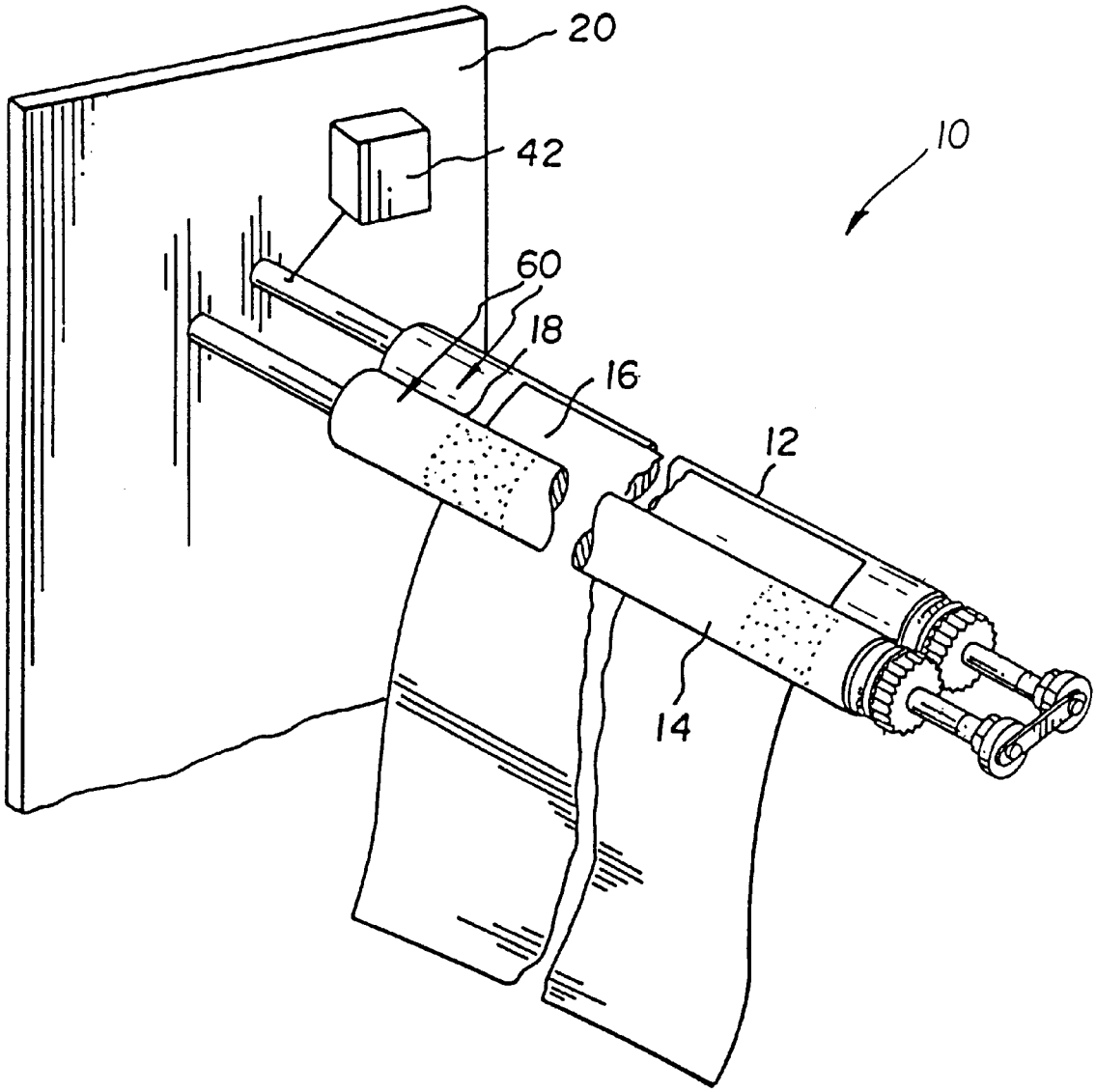
FIG. 2 is a perspective view, partially torn away, of the apparatus of the invention having one roller with a partial media bearing surface.
Figure 3:
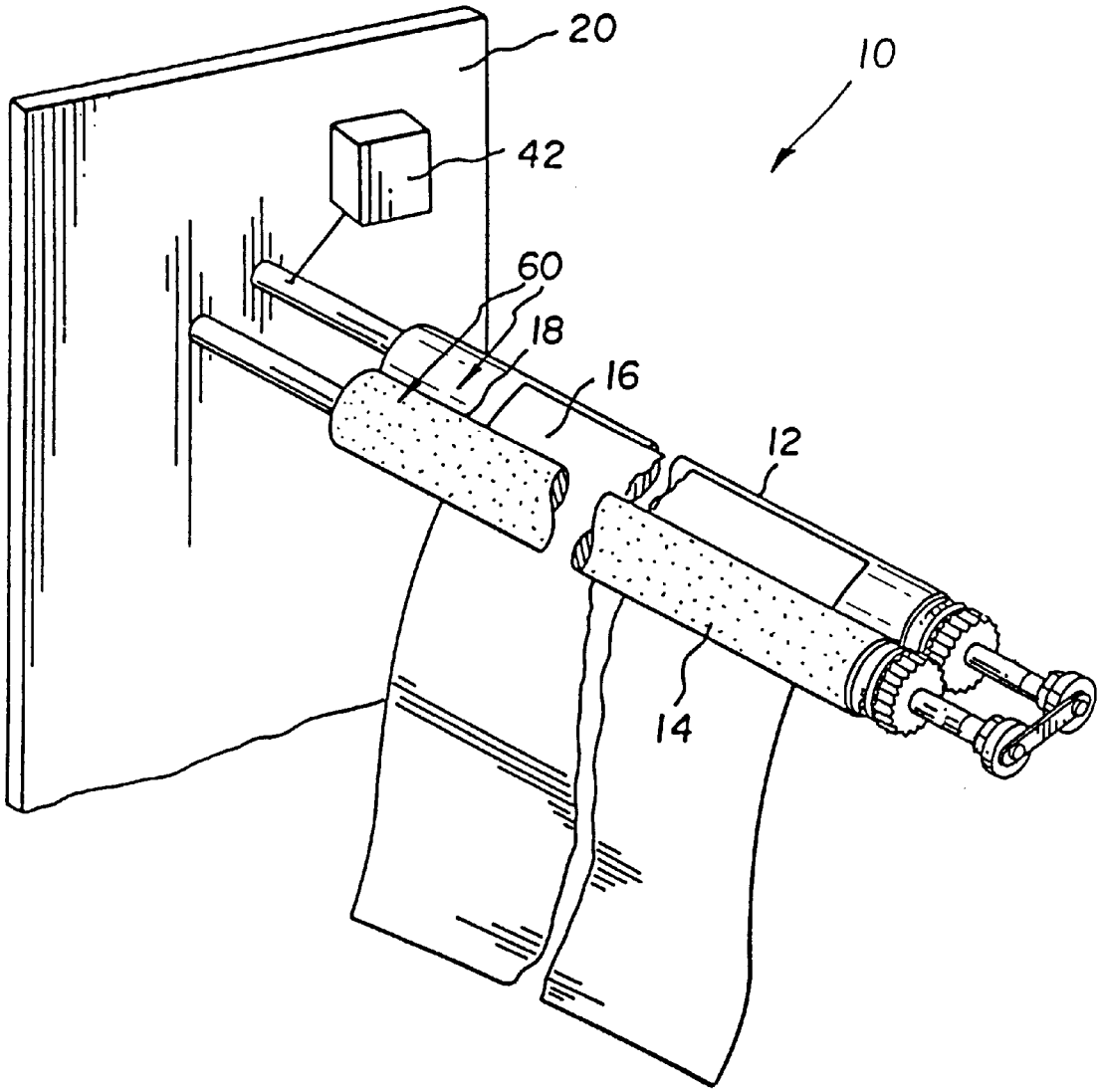
FIG. 3 is a perspective view, partially torn away, of the apparatus of having one roller with a media bearing surface; and, FIG. 4 is a section view along line 4—4 of FIG. 1 depicting a composite media bearing surface of a conveyance roller in contact with abrasive media.

Turning now to the drawings, and more particularly to FIGS. 1–3, abrasive web or media conveyance apparatus 10, broadly defined, includes closely spaced first and second rollers 12, 14, alternately referred to as a squeegee-like roller assemblage 60 (described below) supported in a metal frame 20. It is important to the invention, that either of the first and second rollers 12, 14 has a media bearing surface, denoted by 70 (FIG. 4) that comprises an inorganic particulate material in a polymeric matrix, described in details below. For clarity, the media bearing surface is defined as the outermost surface of the roller on which the media or web 16 rides as the web 16 is being conveyed through the nip or close spacing 18 between the rollers 12, 14. Skilled artisans will appreciate that the media bearing surface need not include the entire surface area of the roller, but only the active portion of the outermost surface minimally required to promote continuous movement of the abrasive material through the nip. It is within the contemplation of the invention that a plurality of cooperating conveyance rollers (not shown) may have coated media bearing surfaces of the type described herein. Thus, media bearing surface 70 having the polymer/inorganic composite was selected because it provides sufficient compliance to accommodate for the conveyance of abrasive media of varying thickness. Importantly, media bearing surface 70 also provides sufficient friction to enable continuous movement of the abrasive media as it is transported between processing stations (not shown). Skilled artisans will appreciate that while any one of rollers 12, 14 (shown in FIG. 3) may have a media bearing surface 70 comprising the polymeric/inorganic composite, it is within the contemplation of the invention that both rollers 12, 14 (shown in FIG. 1) or a portion of any one of the media bearing surfaces 70 (shown in FIG. 2) may comprise our preferred polymeric/inorganic composite.

Referring again to FIGS. 1–3, apparatus 10 includes some sort of drive means, such as a drive motor 42, operably connected to any one of the first and second rollers 12, 14 for driving at least one of the first and second rollers 12, 14. Synchronous rotation of the other of the first and second rollers 12, 14 is produced by the driven roller. As any skilled artisan will appreciate, this rotation of the first and second rollers 12, 14 causes the web 16 to be squeezed between the rollers 12, 14 while in contact with the media bearing surface 70 (FIG. 4) for movement through the transport nip 18.

Preferably, the drive mechanism of apparatus 10 includes those elements, such as gears, ceramic bushings and ceramic sleeves that are described in detail in U.S. Ser. No. 09/047,662, filed Mar. 25, 1998, entitled APPARATUS AND METHOD FOR TRANSPORTING A WEB, by Dilip K. Chatterjee, Syamal K. Ghosh, and Edward P. Furlani, hereby incorporated herein by reference. The aforementioned arrangement of elements is preferred because of their ability to effectively operate in a corrosive environment.

Abrasive web or media 16 transportable by apparatus 10 of the invention may include a wide range of materials, including but not limited to, photographic or x-ray films, photographic papers, specialty coated papers or plain papers. Typically, abrasive web or media 16 is introduced through the transport nip 18 formed by the spacing between the first and second rollers 12, 14. The abrasive web or media 16 is then squeezed for movement through nip 18 while being transported from one processing station to another (not shown).

Figure 4:
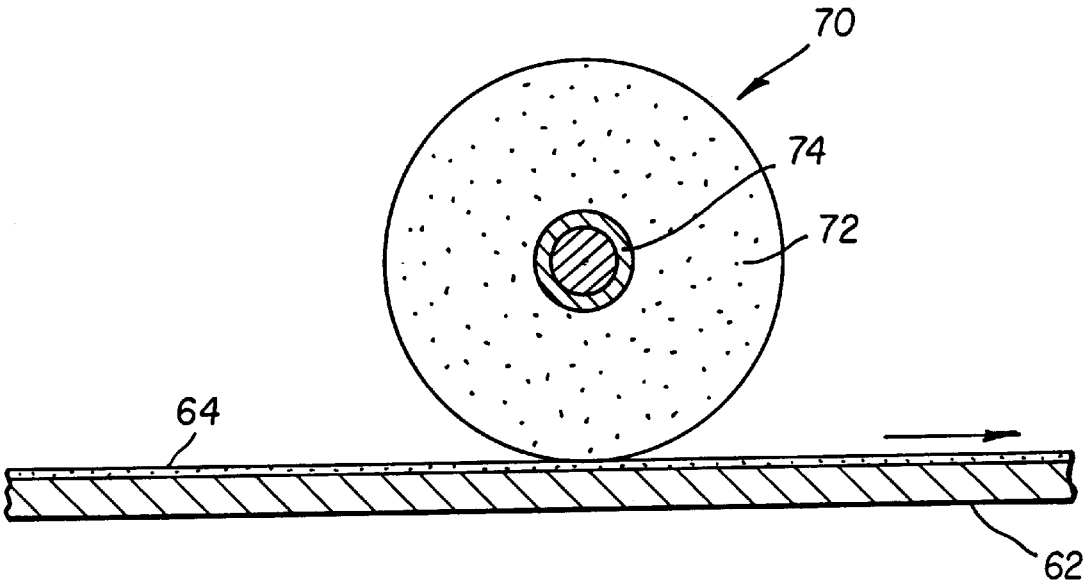

Turning now to FIG. 4, a cross sectional view is shown of one of rollers 12, 14 having media bearing surface 70 in contact with an abrasive layer or coating 64 of media 62. In the preferred embodiment, media bearing surface 70 comprises polyurethane having embedded therein hard inorganic particulates, described below. Other embodiments may include synthetic rubber, silicone or a mixture thereof, each having embedded therein hard inorganic particulates 72 to make the roller wear and abrasion resistant.

The preferred inorganic particulate materials include ceramic particles such as alumina, silicon carbide, silicon nitride, titanium boride and the like mixed with an organic polymeric slurry and then cast on a metal, preferably aluminum or stainless steel, mandrel 74. Most preferred among the inorganic particulate materials is alumina.

It is important to the integrity of the media bearing surface 70 of the invention that the polymeric/inorganic particulate composite contain a concentration in the range of about 5 weight-% to about 50 weight-% inorganic (ceramic) particles, preferably 20 weight-%. In this way, the hardness of the composite (polymer+inorganic particles) media bearing surface 70 does not exceed Shore hardness A 95, and preferably is in the range of about 60 and 95.

In another aspect of the invention, a method of conveying abrasive media 16 includes the step of providing the apparatus 10 (described in details above) having the media bearing surface 70, as indicated above. The abrasive media 16, for example, photographic film or paper, is introduced into the nip 18 and squeezed between rollers 12, 14 while in moving contact with the inorganic/polymeric composite media bearing surface 70.

Thus, the invention has been described in detail with particular reference to certain preferred embodiments thereof, but it will be understood that variations and modifications can be effected within the spirit and scope of the invention.

What is claimed is:

1. Apparatus for conveying abrasive media of indeterminate length, comprising:

a frame;

first and second rollers mounted for synchronous rotation in said frame, said first and second rollers being closely spaced to form a nip therebetween, and wherein at least one of said first and second rollers has at least a media bearing surface for contacting said abrasive media passing through said nip, said media bearing surface comprising, in a mixture, a polymeric matrix and an inorganic particulate material, wherein said inorganic particulate material is in said mixture at a concentration in a range of between about 5% by weight and 50% by weight; and, drive means operably connected to any one of said first and second rollers for rotating said any one of said first and second rollers.

2. The apparatus recited in claim 1, wherein said hard inorganic particulate material is selected from the group consisting of:

(a) alumina;

(b) silicon carbide;

(c) silicon nitride; and (d) titanium boride.

3. The apparatus recited in claim 1, wherein said polymeric matrix is selected from the group consisting of:

(a) synthetic rubber;

(b) silicone; and (c) polyurethane.

4. The apparatus recited in claim 1 wherein said inorganic particulate has a concentration of 20 weight-%.

5. The apparatus recited in claim 1 wherein said at least one of said first and second rollers has a Shore hardness A in the range of about 60 to about 95.

* * * * *